United States Patent [19]

Krautzberger

[11] Patent Number: 4,907,631

[45] Date of Patent: Mar. 13, 1990

[54] BLADE ASSEMBLY FOR PLANER CUTTER HEAD

[75] Inventor: Dieter Krautzberger, Bad Kreuznach, Fed. Rep. of Germany

[73] Assignee: Babcock-BSH Aktiengesellschaft vormals Büttner-Shilde-Haas AG, Krefeld, Fed. Rep. of Germany

[21] Appl. No.: 315,552

[22] Filed: Feb. 24, 1989

[30] Foreign Application Priority Data

Apr. 7, 1988 [DE] Fed. Rep. of Germany ..... 3811601

[51] Int. Cl.[4] ..... B27G 13/00

[52] U.S. Cl. ..... 144/230; 407/49; 407/51; 144/117 R

[58] Field of Search ..... 144/230, 226, 236, 117 R; 407/33, 41, 49, 50, 51, 46

[56] References Cited

U.S. PATENT DOCUMENTS

| | | | |
|---|---|---|---|
| 3,740,808 | 6/1973 | Shioya | 407/49 |
| 3,868,751 | 3/1975 | Holthuis | 407/49 |
| 4,068,694 | 1/1978 | Schmidt | 407/51 |
| 4,194,545 | 3/1980 | Kostrmeier | 144/230 |
| 4,487,240 | 12/1984 | Bengler | 407/49 |

OTHER PUBLICATIONS

Article "Werkzeugfragen in der Maschinellen Holzbearbeitung" by Johannes Lindner, DE-Z Holztechnik, 35th Year, vol. 9, p. 411 (First Page Only).

*Primary Examiner*—W. Donald Bray
*Attorney, Agent, or Firm*—Herbert Dubno

[57] ABSTRACT

A cylindrical cutter head comprises a cutter head body having a cylindrical surface which is centered on an axis and which is formed with a plurality of radially outwardly open main grooves extending parallel to the axis and each having relative to a normal direction of rotation of the body about the axis a leading flank and a trailing flank. These flanks are generally planar and converge radially outward. A disposable knife blade in each of the grooves is pressed against the trailing flank thereof by an outwardly tapered centrifugal wedge braced radially between the blade and the leading flank. Each groove is formed immediately forward of its trailing flank with a radially inwardly projecting groove extension. Thus wide regrindable blades can be fitted in the groove with their rear edges seated in the respective groove extensions.

4 Claims, 2 Drawing Sheets

BLADE ASSEMBLY FOR PLANER CUTTER HEAD

FIELD OF THE INVENTION

The present invention relates to a blade assembly for a planar cutter head. More particularly this invention concerns a system for securing a removable and/or reversible blade in a generally cylindrical cutting drum of a planer or the like.

BACKGROUND OF THE INVENTION

In my copending patent application 07/296,871 filed Jan. 12, 1989 as a continuation of my now abandoned patent application 07/115,008 filed Oct. 28, 1987 I describe a cylindrical cutter head comprising a cutter head body having a cylindrical surface which is centered on an axis and which is formed with a plurality of radially outwardly open grooves extending parallel to the axis and narrowing toward the surface of the cutter head body. A disposable knife blade clamped in each of the main grooves has an axially extending formation and a centrifugal wedge positioned in each of the main grooves clamps the knife blade. A one-piece holding bracket interposed between the knife blade and the centrifugal wedge has a pair of unitary but relatively elastically displaceable parts one of which is engageable with the blade and in turn has an axially extending formation complementary to and interfitting with the formation of the blade. The other part of the bracket is fixed to the cutter head body and the bracket is elastically deformable for displacement of its one part between a normal position spaced slightly from the blade and permitting axial insertion and release of the knife blade and a holding position bearing on the blade and pressing same against the side of the main groove. The wedge is angled and positioned such that on rotation of the body it is urged centrifugally outward and presses the one part of the bracket into the holding position.

Furthermore in my prior-art system the holding bracket is constituted by a single L-cross-section profile having one leg forming the one part and another leg forming the other part. Screws attach the base strip to the floor of the main groove. This main groove has a stepped floor with a lower level to which the one leg of the bracket is screwed and which extends all the way to the trailing main-groove flank, and an upper level extending from the leading edge of the lower level to the leading flank of the groove. Both of these levels are formed as surfaces substantially perpendicular to the surfaces they terminate at, that is the trailing lower level is perpendicular to the trailing flank and the leading upper level to the leading flank.

Such a system is extremely simple and can, therefore, be built at very low cost while being easy to use. It nonetheless has the disadvantage that it is intended for use only with relatively narrow single-use blades, that is blades with a single cutting edge that cannot normally be reground and reused. Unfortunately many applications where the blade is subject to considerable wear or is likely to strike foreign objects necessitate the use of relatively wide double-edge or regrindable blades.

Accordingly a blade assembly such as described in DE-Z Holztechnik (35th year, 1955, volume 9, pages 411ff) where the cutter body, which is centered on and rotated about an axis, has a pair of diametrically opposite slots. Each slot has, relative to the normal direction of rotation of the cutter body, a leading flank which extends substantially radially of the blade axis and a trailing flank which forms an acute angle with a radius of the blade axis and which converges radially outward with the leading flank. The main groove further has a floor or base surface that extends perpendicular to the leading flank, that is tangent at the leading flank to an imaginary cylinder centered on the cutter-body axis. Formed in this main groove is a secondary groove having a trailing flank that is a coplanar extension of the main groove's trailing flank. This secondary groove or groove extension allows one to use standard wide blades that can be ground down and then reinstalled for many uses. Such a blade lies on the inclined trailing wall of the main groove and projects with its blunt back edge radially inward into the groove extension. Between the blade and the leading flank there is a wedge-section clamping bar which is braced with screws against the leading flank. Such an arrangement does allow a regrindable blade to be used, but is somewhat complex. It does not, however, allow narrow single-use or reversible blades to be employed.

OBJECTS OF THE INVENTION

It is therefore an object of the present invention to provide an improved blade assembly for a planar cutter drum.

Another object is the provision of such an improved blade assembly for a planar cutter drum which overcomes the above-given disadvantages, that is which can be used with more than one type of blade, preferably both with narrow reversible or single-use blades and wide regrindable blades.

SUMMARY OF THE INVENTION

The instant invention is in a cylindrical cutter head comprising a cutter head body having a cylindrical surface which is centered on an axis and which is formed with a plurality of radially outwardly open main grooves extending parallel to the axis and each having relative to a normal direction of rotation of the body about the axis a leading flank and a trailing flank. These flanks are generally planar and converge radially outward. A disposable knife blade in each of the grooves is pressed against the trailing flank thereof by an outwardly tapered centrifugal wedge braced radially between the blade and the leading flank. According to this invention each groove is formed immediately forward of its trailing flank with a radially inwardly projecting groove extension. Thus wide regrindable blades can be fitted in the groove with their rear edges seated in the respective groove extensions.

According to another feature of this invention the body is further formed along each groove with a series of bores extending along the trailing flank radially inward past the respective groove extension. These bores can house the springs normally employed with a wide regrindable blade.

In accordance with a further feature of the invention the assembly comprises a one-piece holding bracket interposed between the knife blade and the centrifugal wedge and having a pair of unitary but relatively elastically displaceable legs one of which is engageable with the blade and has an axially extending formation complementary to and interfitting with the formation of the blade. The other leg of the bracket is fixed to the cutter head body and the bracket is elastically deformable for displacement of its one leg between a normal position spaced slightly from the blade and permitting insertion and release of the knife blade and a holding position bearing on the blade and pressing same against the side of the groove, the wedge being angled and positioned such that on rotation of the body it is urged centrifugally outward and presses the one leg of the bracket into the holding position. This construction makes the system employable with a narrow reversible or single-use blade that does not project inward in to the groove extension.

The grooves extensions according to this invention are each a secondary groove having a rear flank coplanar with the rear flank of the respective main groove. In addition the main grooves each have a radially outwardly directed floor including a substantially planar leading surface substantially perpendicular to the leading flank and a substantially planar trailing surface spaced radially inward from the respective leading surface, lying between the respective leading surface and the respective extension, and substantially perpendicular to the respective trailing flank.

DESCRIPTION OF THE DRAWING

The above and other objects, features, and advantages will become more readily apparent from the following, reference being made to the accompanying drawing in which.

SPECIFIC DESCRIPTION

Figure 1:
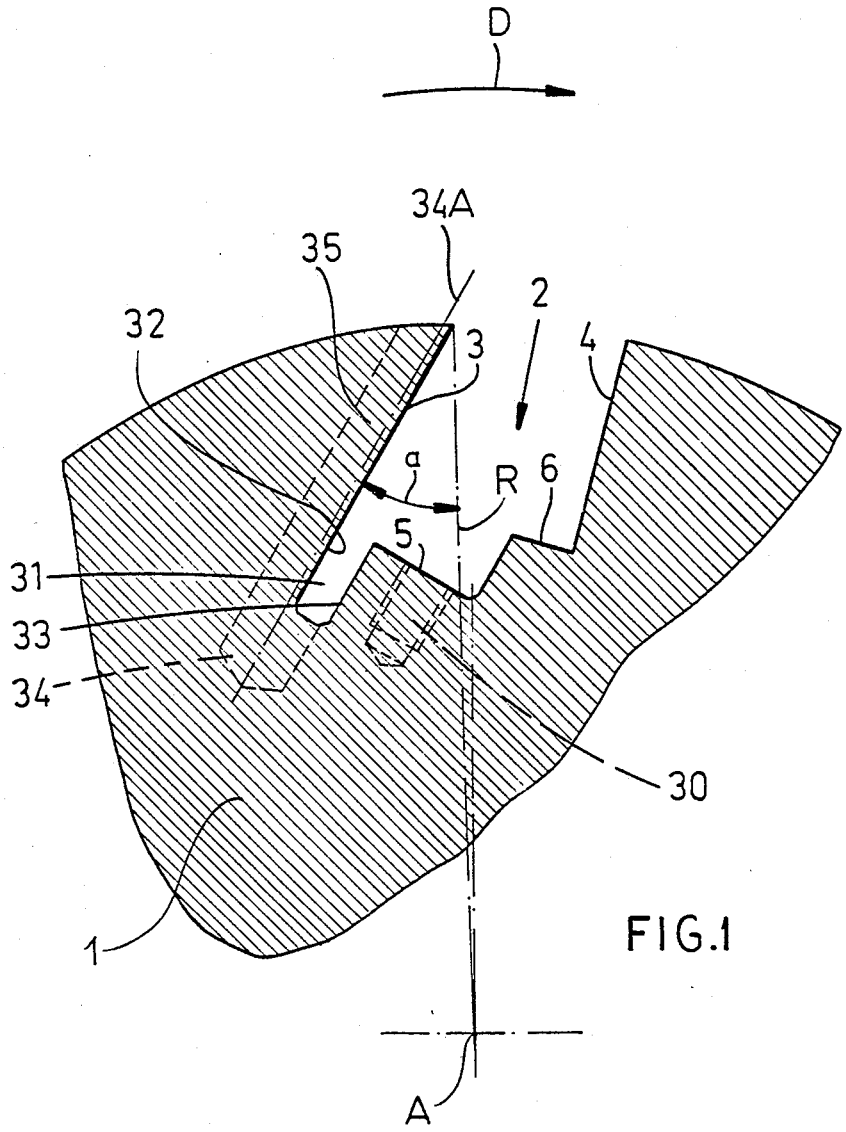
FIG. 1 is a large-scale cross-sectional view of the portion of a cutter drum where a blade is attached.

As seen in FIG. 1 a basically cylindrical one-piece cutter drum or body 1 formed of steel and centered on an axis A is formed on its cylindrical outer surface with a plurality of identical and angularly equispaced grooves 2 each having, relative to a normal rotation direction D of the body 1, a planar trailing flank 3 and a planar leading flank 4. The plane of the flank 3 extends parallel to the axis A but at an angle a of about 30° to a radius R drawn from the axis A while the plane of the flank 4 extends virtually parallel to a respective such radius drawn from the axis A. The groove 2 has a trailing floor surface 5 extending parallel to the axis A and perpendicular to the trailing flank 3 and a leading floor surface 6 extending parallel to the axis A and perpendicular to the leading flank 4. The leading surface 6 is radially outward of the trailing surface 5.

The groove 2 is formed flush with the trailing flank 3 with a groove extension 31 whose trailing flank is a coplanar extension of the trailing flank 3 and whose leading flank terminates at the trailing edge of the trailing surface 5. The radial width between the parallel leading and trailing flanks of the groove extension 31 is wider than the maximum blade width, here being about 5mm. The depth of the groove extension 31 beyond the surface 5 is 10mm to 15mm.

In addition the body 1 is formed along each groove 2 with a succession of bores 34 that extend parallel to and are in fact bisected by the flank 3. These bores 34, whose axes 34A lie on the flank 3, therefore constitute semicircular grooves in the flank 3 and extend past the floor of the groove extension by 10mm to 15mm. They therefore also have diameters equal to twice the width of the groove extension 31.

Figure 2:
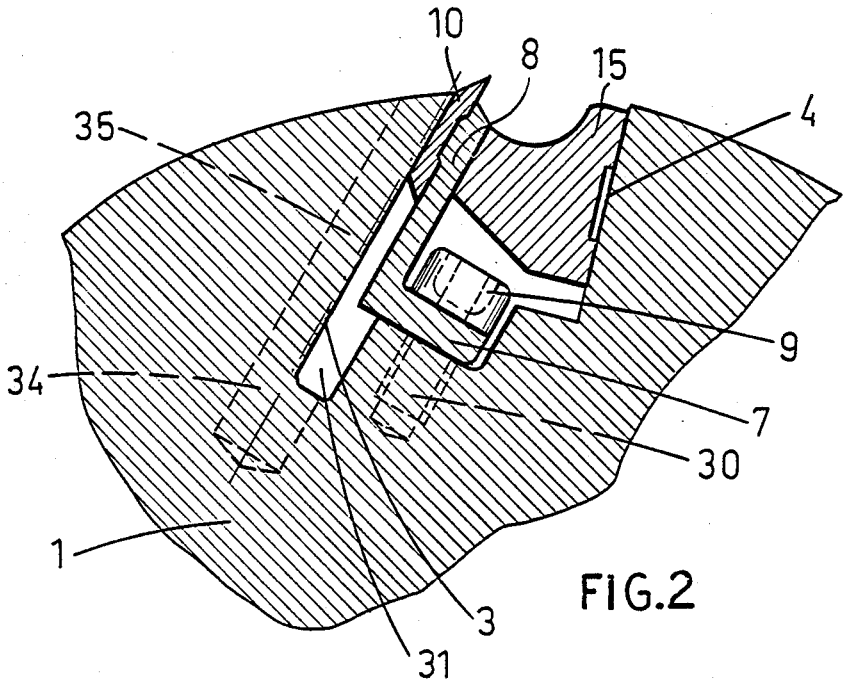
FIG. 2 is a view like FIG. 1 but showing a narrow reversible blade assembly.

FIG. 2 shows a narrow double-edge blade 10 secured against the flank 3 by an L-shaped holding bracket 8 having a short leg 7 bolted against the surface 5 by bolts 9 seated in bores 30 opening at this surface 5. The L-section bracket 8 is elastically deformable and has a ridge received as described in the above-mentioned patent applications in a complementary forwardly open groove in the trapezoidal-section blade 10. A wedge 15 has a leading side braced against the flank 4 and a trailing flank braced against the long arm of the bracket 8 so that, as the drum 1 rotates this wedge bar 15 is driven by centrifugal force radially outward and therefore clamps the blade 10 tightly in place. This arrangement is substantially identical to that of the above-referenced patent applications. Thus in this arrangement the extension 31 and holes 36 are not used.

Figure 3:
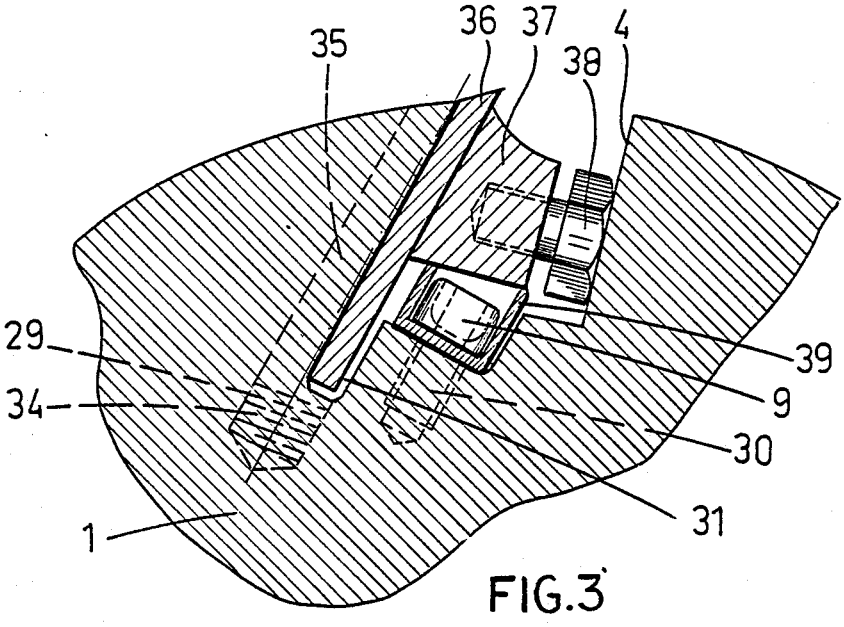
FIG. 3 is a view like FIG. 1 but showing a wide regrindable blade.

In addition the system of this invention can be used as illustrated in FIG. 3 with a regrindable blade 36 that is fairly wide so that it engages down into the groove extension 31 with its blunt back edge almost at the bottom of this extension 31. Coil springs 29 are braced between the bottom of each hole 34 and the rear edge of the blade 36. A wedge bar 37 is provided with a series of bolts 38 whose heads bear against the leading flank 4 and this bar 37 lies atop a channel guide 39 secured by the bolts 9 to the surface 5. With this arrangement the blade 36 is pushed in by an appropriate setting device against the force of the springs 29 until the right position is reached, then the bolts 38 are backed out to clamp the assembly tightly together.

Thus the cutter according to this invention can be used with two different types of blades. The owner of the equipment is not precluded from switching blade types to use up existing stock and/or work different materials.

I claim:

1. In a cylindrical cutter head comprising:

a cutter head body having a cylindrical surface which is centered on an axis and which is formed with a plurality of radially outwardly open main grooves extending parallel to the axis and each having relative to a normal direction of rotation of the body about the axis a leading flank and a trailing flank, the flanks being generally planar and converging radially outward;

a disposable knife blade in each of the grooves against the trailing flank thereof; and an outwardly tapered centrifugal wedge positioned in each of the grooves and braced radially between the blade and the leading flank; the improvement wherein each groove is formed immediately forward of its trailing flank with a radially inwardly projecting groove extension, whereby wide regrindable blades can be fitted int he groove with their rear edges seated in the respective groove extensions, said cutter head further comprising a one-piece holding bracket interposed between the knife blade and the centrifugal wedge and having a pair of unitary but relatively elastically displaceable legs one of which is engageable with the blade and has an axially extending formation complementary to and interfitting with the formation of the blade; and means fixing the other leg of the bracket to the cutter head body, the bracket being elastically deformable for displacement of its one leg between a normal position spaced slightly from the blade and permitting insertion and release of the knife blade and a holding position bearing on the blade and pressing same against the side of the groove, the wedge being angled and positioned such that on rotation of the body it is urged centrifugally outward and presses the one leg of the bracket into the holding position.

2. The improved cutter head defined in claim 1 wherein the body is further formed along each groove with a series of bores extending along the trailing flank and radially inward past the respective groove extension.

3. The improved cutter head defined in claim 1 wherein the groove extensions are each a secondary groove having a rear flank coplanar with the rear flank of the respective main groove.

4. The improved cutter head defined in claim 1 wherein the main grooves each have a radially outwardly directed floor including a substantially planar leading surface substantially perpendicular to the leading flank and a substantially planar trailing surface spaced radially inward from the respective leading surface, lying between the respective leading surface and the respective extension, and substantially perpendicular to the respective trailing flank.

* * * * *